US006358087B1

(12) United States Patent
Haar et al.

(10) Patent No.: US 6,358,087 B1
(45) Date of Patent: Mar. 19, 2002

(54) SNAP-FIT ELECTRICAL CONNECTOR

(75) Inventors: Steven M. Haar, White Lake; John L. Brummans, Warren; Thomas K. Lockwood, Fenton, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/688,250

(22) Filed: Oct. 16, 2000

(51) Int. Cl.[7] ..... H01R 13/60; H01R 13/66
(52) U.S. Cl. ..... 439/567; 439/564; 248/222.12
(58) Field of Search ..... 439/557, 594, 439/717, 527, 567, 575, 570, 573, 564; 248/222.11, 222.12, 222.13

(56) References Cited

U.S. PATENT DOCUMENTS 2,469,451 A * 5/1949 Burrus ..... 248/222.12
4,719,542 A * 1/1988 Lemmer ..... 248/222.12
4,867,599 A * 9/1989 Sasajima ..... 248/222.12
5,800,208 A * 9/1998 Ishizuka et al. ..... 439/557
5,820,394 A * 10/1998 Kameyama et al. ..... 439/557
6,053,765 A * 4/2000 Eakins ..... 439/557
6,190,197 B1 * 2/2001 Polgar et al. ..... 439/527

* cited by examiner

*Primary Examiner*—Renee Luebke
*Assistant Examiner*—Felix D. Figueroa
(74) *Attorney, Agent, or Firm*—Jeffrey A. Sedlar; Laura C. Hargitt

(57) ABSTRACT

An assembly and method for installing a snap-fit electrical connector, wherein the assembly includes a base; at least one pair of flange members supported by the base for locating a tether, cable or other electrical wiring; at least one pair of resilient members supported by the flanges forming the pair of flange members for engaging a mating recess or opening; and at least one pair of second flange members supported by the base for providing a snap-fit connection with a second mating recess or opening. The snap-fit connector assembly also includes an electrical connector portion supported by the base for providing a location for establishing an electrical connection.

17 Claims, 4 Drawing Sheets

SNAP-FIT ELECTRICAL CONNECTOR

TECHNICAL FIELD

The present invention relates to a snap-fit electrical connector, and more articularly, to a snap-fit electrical connector for locating and securing a tether connector for an automotive vehicle cooling fan application.

BACKGROUND OF THE INVENTION

Conventional connector assemblies, particularly those used in the automobile industry, require the use of mechanical fasteners or other similar devices to secure the connector in position. The current invention provides an apparatus and method for installing a connector assembly that may reduce the number of mechanical fasteners used during the installation.

SUMMARY OF THE INVENTION

The present invention is directed to a snap-fit electrical connector, including a base; at least one pair of flange members supported by the base for locating a tether, cable or other electrical wiring; at least one pair of resilient members supported by the flanges forming the pair of flange members for engaging a mating recess or opening; and at least one pair of second flange members supported by the base for providing a snap-fit connection with a second mating recess or opening. The snap-fit connector assembly also includes an electrical connector portion supported by the base for providing a location for establishing an electrical connection.

This invention is also directed to a method of installing a connector assembly by providing a connector assembly including at least one pair of flange members for locating a tether, cable or other electrical wiring within the connector assembly; providing one or more resilient members for establishing a frictional engagement with a mating opening or recess for securing the connector assembly in position; providing an electrical connector supported by the connector assembly for providing a location for establishing an electrical connection with the tether, cable or other electrical wiring.

BRIEF DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

The invention relates to a snap-fit electrical connector for guiding and locating a tether connector. In its most general form, the electrical connector includes a base and a pair of tether guide flanges supported by the base. The end portion of each guide flange is configured to snap-fit into a mating recess or opening. In operation, the end portion of each guide flange snaps into a mating recess or opening formed in a fan bracket assembly for an automotive vehicle to secure the electrical connector assembly in position while the guide flanges help locate the tether in position.

Figure 1:
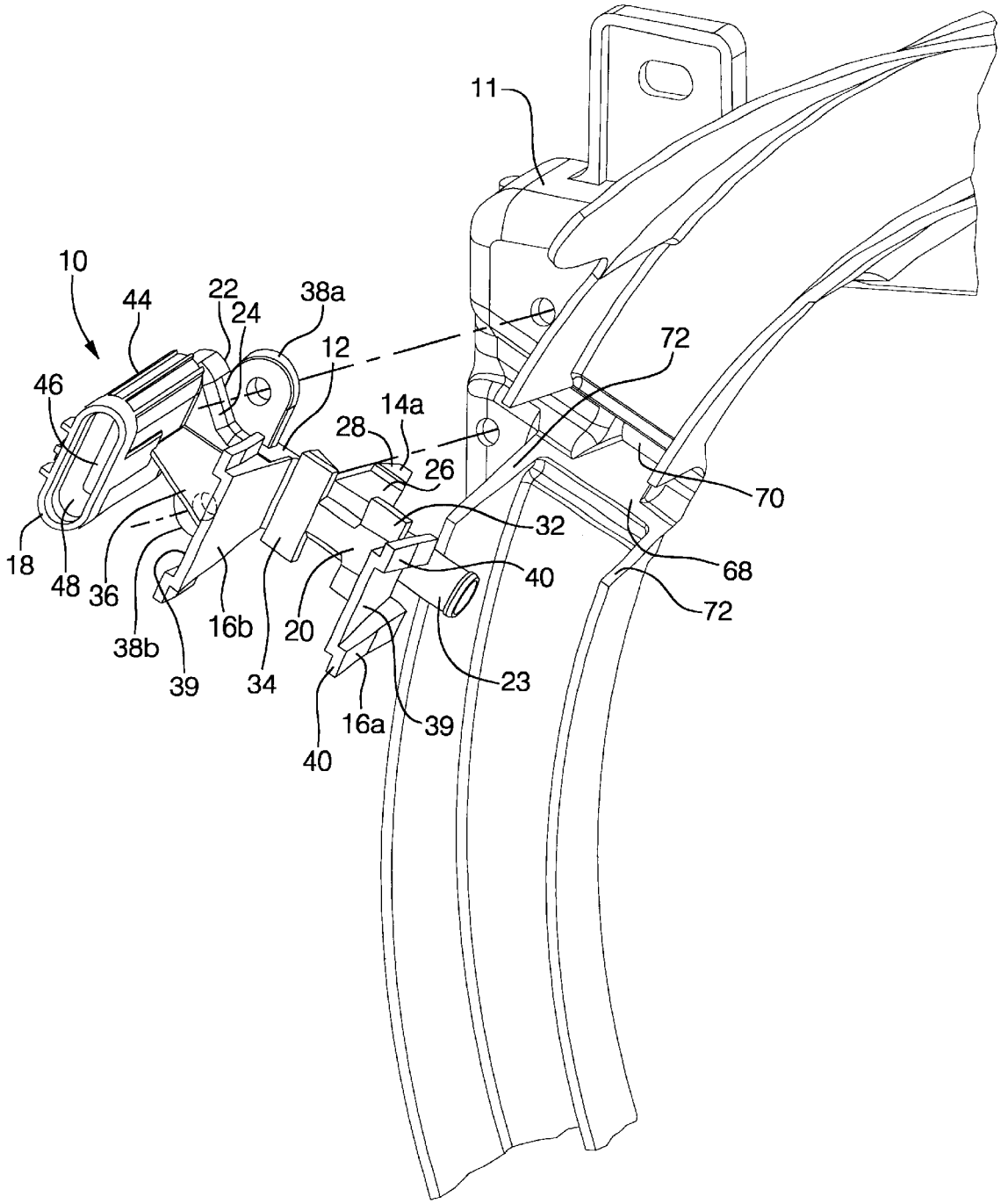
FIG. 1 shows a perspective view of a snap-fit electrical connector formed in accordance with the teachings of the present invention and one position of the connector when installed in a cooling fan bracket assembly.
Figure 2:
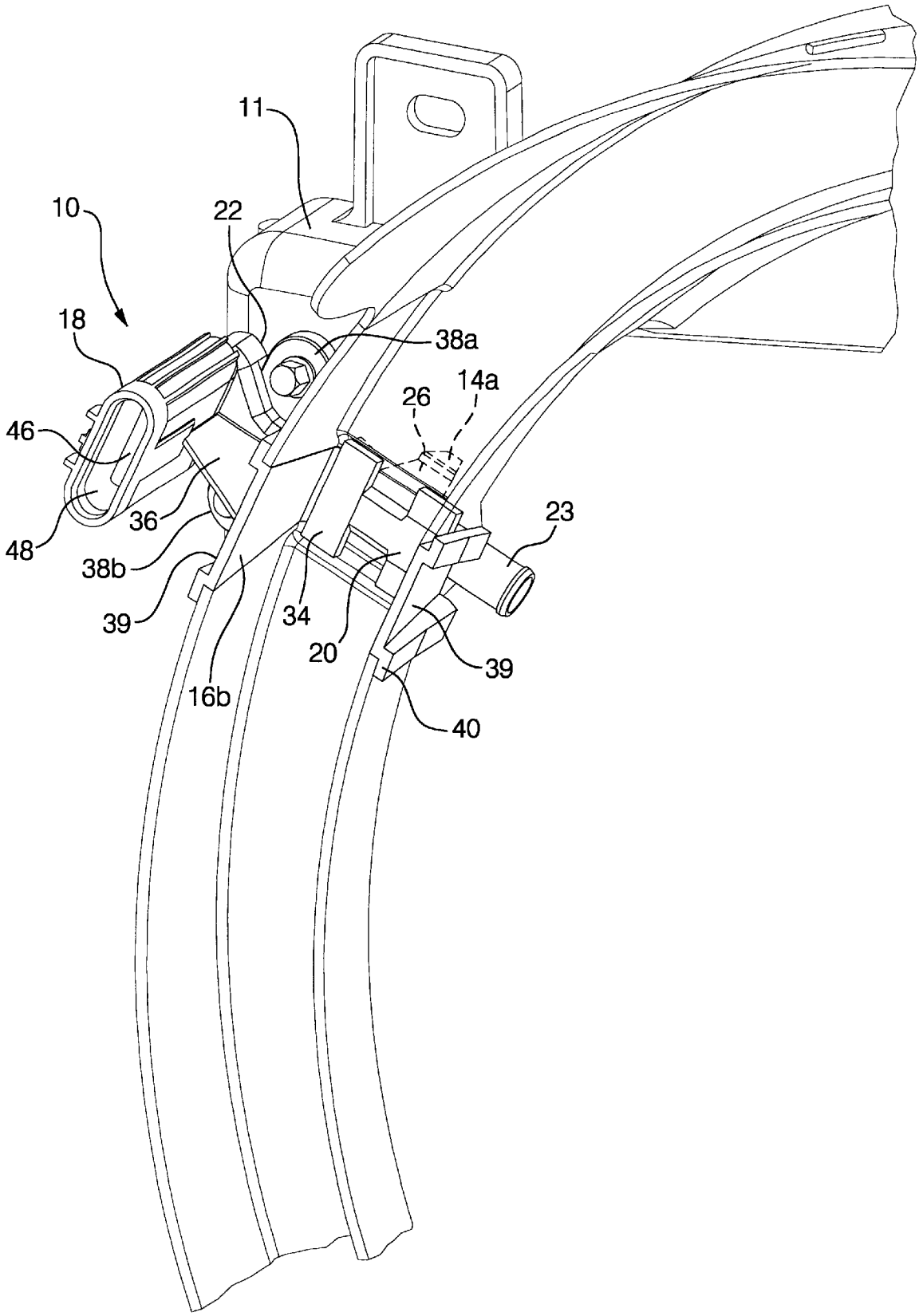
FIG. 2 is a rear view of the connector and fan bracket shown in FIG. 1.

FIG. 1 shows a perspective view of a snap-fit electrical connector assembly 10 formed in accordance with the teachings of this invention, and how the electrical connector assembly 10 could be located in a cooling fan bracket assembly 11. The electrical connector assembly 10 includes a base 12, a first pair of tether guide flanges 14*a, b*, a second pair of flanges 16*a, b,* and an electrical connector portion 18.

Figure 3:
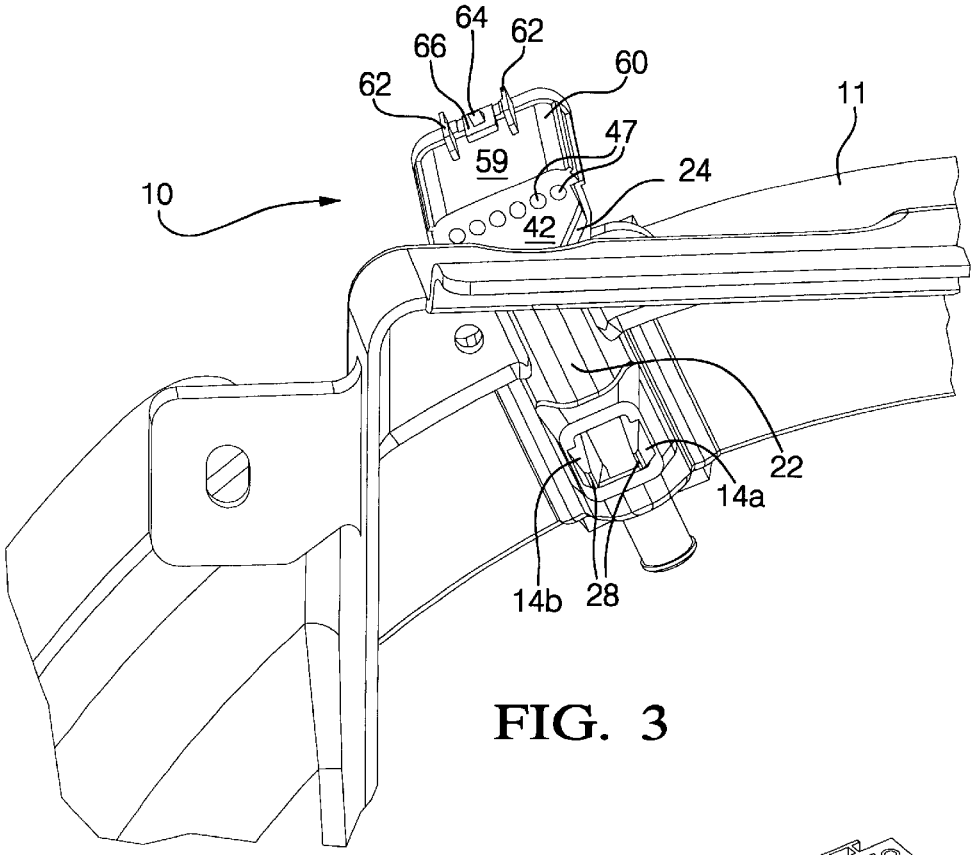
FIG. 3 is front view of connector of FIG. 1 installed in the fan bracket shown in FIG. 1.
Figure 4:
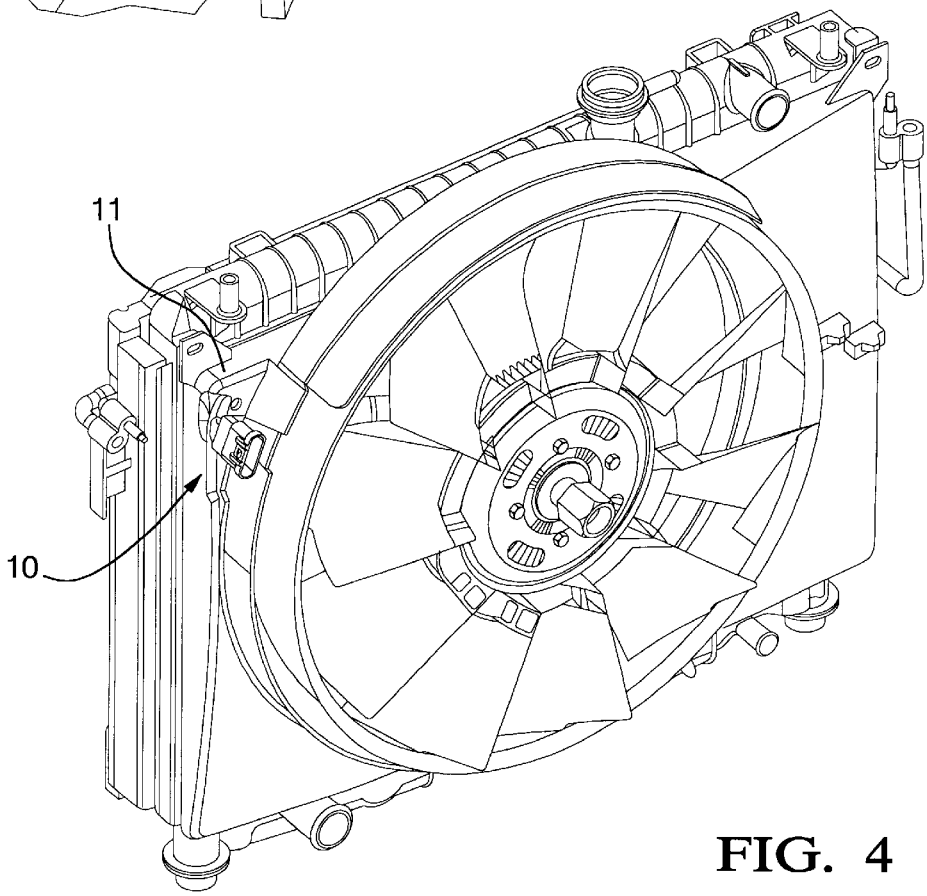
FIG. 4 is a perspective view of a cooling fan assembly having the snap-fit electrical connector of FIG. 1 coupled thereto.
Figure 5:
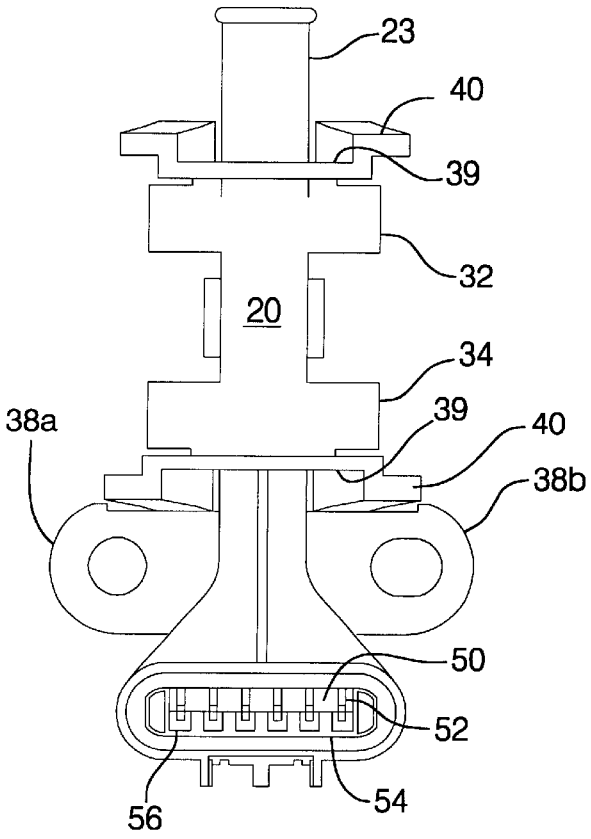
FIG. 5 is a rear view of the connector shown in FIG. 2, wherein additional detail is shown regarding the connector portion of the snap-fit electrical connector.

Turning now to a detailed description of each element of the connector assembly 10, the base 12 is an elongated member, which in one embodiment can extend substantially the entire length of the electrical connector assembly 10. In the disclosed embodiment, the base 12 includes a planar rear surface 20 and a front surface 22 defining a semi-cylindrically shaped portion, best seen in FIG. 3.

The front surface 22 of the base 12, at one end, supports a cylindrically shaped guide 23 having an open center, and at the other end the base 12 defines a Y-shaped channel 24. Adjacent the Y-shaped channel 24, the base supports a pair of connector flanges 38*a, b,* one flange extending laterally outward from each side of the Y-shaped channel 24 and includes an opening therein for receiving a mechanical fastener such as a screw, pin screw or other similar device.

Figure 6:
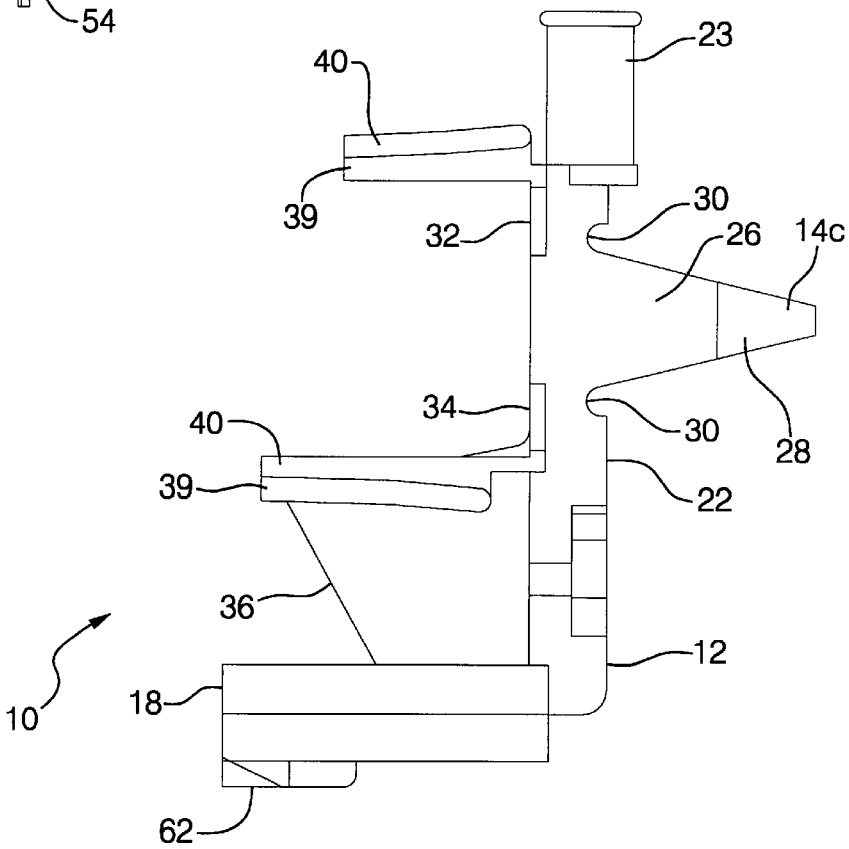
FIG. 6 is a profile view of the snap-fit electrical connector shown in FIG. 1.

Turning now to the tether guide flanges 14*a, b*, each guide flange 14*a, b* includes a planar extension 26 that supports a flexible barbed end portion 28. As best seen in FIGS. 1 and 6, the extension 26 of each flange 14*a, b* extends outwardly from opposing edges of the front surface 22, and is flanked at its beginning and ending portion by a U-shaped groove 30 formed in the edge portion of the front surface 22.

The electrical connector assembly 10 also includes a pair of dovetail flanges 16*a, b* that extend outwardly from the rear surface 20 of the base 12. One of skill in the art will appreciate that other flange constructions can be used to perform the function of the flanges 16*a, b*.

Each flange 16*a, b* includes a recessed planar dovetail shaped portion 39. The opposing side edges of the dovetail shaped portion 39 support an L-shaped flange 40, wherein the L-shaped flange 40 extends outwardly from the dovetail shaped portion 39 such that a portion of the L-shaped flange 40 extends outwardly from and is vertically offset from the dovetail shaped portion 39.

As also shown in FIG. 1, the L-shaped flanges 40 of the respective flanges 16*a, b* extend in opposite directions, one projecting upward and the other downward. As shown in FIG. 1, the electrical connector assembly 10 also includes a pair of rectangularly shaped stops 32 and 34 positioned intermediate of the pair of dovetail flanges 16*a, b*.

Turning now to the electrical connector portion 18, the electrical connector portion 18 includes an elongated portion 44 having an open center 46. A connector guide 48 is formed in the open center 46 and includes an upper plate 50 supporting a plurality of fingers 52 extending outwardly therefrom and a lower plate 54 defining a plurality of spaced apart ridges 56 positioned adjacent the fingers 52.

The electrical connector portion 18 also includes a rear surface 42 substantially bounded by the Y-shaped end portion 24 of the base 12. The rear surface 42 includes a plurality of openings 47 that permit access to the open center 46.

The top surface of the electrical connector portion 18 supports an inclined surface 36 that extends upwardly and abuts the recessed surface 39 of the lower flange 16*b*.

The bottom surface 59 of the connector portion 18 includes a pair of ridges 60, which project axially along the entire length of the surface 59. The bottom surface 59 also includes a second pair of axially extending guides 62; however, the guides 62 extend along only a portion of the length of the surface 59. Positioned intermediate the guides 62 is a tab 64 supported by a support plate 66.

Installation and Operation

As best seen in FIG. 1, the connector assembly 10 is positioned in recess 68 formed in the fan bracket assembly 11. The barbed end portions 28 of the pair of tether guide flanges 14*a, b* snap into mating openings 70 formed in the bracket 11. The dovetail flanges 16*a, b* are received in a recessed portion 72 of the bracket 11 such that the L-shaped flange 40 of the respective flanges 16*a, b*, rests on the surface of the fan bracket 11. The combination of the barbed end portions 28 and the dovetail flanges 16*a, b* in contact with the fan bracket assembly 11 may help to reduce the axial and lateral movement of the connector assembly 18 within the fan bracket assembly 11.

Prior to coupling the snap-fit connector 10 to the bracket 11, tether, cable or other electrical wiring is received in the cylindrically shaped guide 23. The tether, cable or other electrical wiring is received in the channel portion of the front surface 22, wherein the channel portion of the front surface 22 extends between the tether guide flanges 14*a, b*. The tether guide flanges 14*a, b* position the tether and help direct the tether, cable or other electrical wiring to be connector portion 18, wherein desired electrical connections are established using conventional techniques.

The preferred embodiment of the present invention has been disclosed. A person of ordinary skill in the art would realize, however, that certain modifications would come within the teachings of this invention. Therefore, the following claims should be studied to determine the true scope and content of the invention.

What is claimed is:

1. A snap-fit connector assembly for a cooling fan bracket, comprising:

a cooling fan adapted for rotation in a first plane;

a cooling fan bracket including a first wall portion that is substantially parallel to said first plane of rotation of said cooling fan and a second wall portion projecting from said first wall and being disposed circumferentially about said cooling fan, said cooling fan bracket having at least one aperture defined in said first wall portion;

said cooling fan bracket having at least one recess, proximate said aperture, defined in said second wall portion;

an electrical connector adapted for placement in said recess, said electrical connector including:

a base having a first end proximate to said fan and a second end distal to said fan;

at least one pair of guide flange members disposed between said first end and said second end and adapted for penetration through said aperture and securingly engaging said first wall portion;

an electrical connector portion adjoining said second end of said base, said electrical connector portion having an open center adapted for receiving electrical wiring; and at least one second flange member that projects substantially away from said first wall portion, said second flange member being configured to have a shape that is substantially complementary with said recess in said second wall portion so that, upon installation of said connector in said bracket, said second flange member and said second wall portion define a substantially continuous surface.

2. The connector of claim 1, further comprising a connector flange adapted for receiving a fastener to join said connector with said bracket.

3. The connector of claim 2, wherein said base is hollow, said connector portion projects from said base in a direction substantially away from said guide flange members, and said guide flange members are adapted for snap-fit engagement with said first wall portion through said aperture.

4. The connector of claim 1, wherein said second wall portion includes a pair of radially spaced walls.

5. The connector of claim 1, wherein said second flange member is dovetail-shaped.

6. The connector of claim 1, wherein said electrical connector portion has an elongated oval configuration.

7. The connector of claim 1, wherein said base is hollow.

8. The connector of claim 1, wherein said connector portion projects from said base in a direction substantially away from said guide flange members.

9. A snap-fit connector assembly for a cooling fan bracket, comprising:

a cooling fan adapted for rotation in a first plane;

a cooling fan bracket including a first wall that is substantially parallel to said first plane of rotation of said cooling fan, a second wall projecting from said first wall and being disposed circumferentially about said cooling fan, and a third wall radially spaced relative to said second wall and substantially parallel therewith, said cooling fan bracket having at least one aperture defined in said first wall;

said cooling fan bracket having a pair of opposing recesses, proximate said aperture, defined respectively in said second wall and said third wall;

an electrical connector adapted for placement in said recesses, said electrical connector including:

a hollow base having a first end proximate to said fan and a second end distal to said fan and being adapted for receiving electrical wiring;

at least one pair of resilient guide flange members each having a barbed end, said guide flange members being disposed between said first end and said second end and being adapted for penetration through said aperture for snap-fit attachment of said electrical connector to said cooling fan bracket;

an electrical connector portion adjoining said second end of said base, said electrical connector portion having an oval face defining an open center adapted for providing an electrical connection;

a first pair of L-shaped flanges that are attached to and offset from a first dovetail portion on said base that projects substantially away from said first wall, a second pair of L-shaped flanges that are attached to and offset from a second dovetail portion on said base that projects substantially away from said first wall;

said first dovetail portion and said second dovetail portion being spaced from each other at substantially a same distance as said opposing recesses in said second wall and said third wall;

said first dovetail portion and said second dovetail portion each being configured to have a shape that is substantially complementary with the structure defining said recess in said second wall so that, upon installation of said connector in said bracket, said dovetail portions and said second and third walls define a substantially continuous surface, and said L-shaped flanges help to secure said connector against movement in a direction substantially parallel to said first plane.

10. The connector of claim 9, wherein each of said pairs of L-shaped flanges are offset in opposite directions relative to each other.

11. The connector of claim 9, wherein said electrical connector portion includes a plurality of openings defined in a wall opposite said face for permitting access to said open center.

12. The connector of claim 9, wherein said dovetail portions and said electrical connector portion project from said base in substantially a same direction.

13. A snap-fit connector assembly for an automotive vehicle cooling fan bracket, comprising:

an automotive vehicle cooling fan adapted for rotation in a first plane;

a cooling fan bracket including a first wall portion that is substantially parallel to said first plane of rotation of said cooling fan and a second wall projecting from said first wall portion and being disposed circumferentially about said cooling fan, said cooling fan bracket having at least one aperture defined in said first wall portion;

said cooling fan bracket having at least one recess, proximate said aperture, defined in said second wall portion;

an electrical connector adapted for placement in said recess, said electrical connector including:

a hollow base having a longitudinal axis and a first end proximate to said fan and a second end distal to said fan;

a connector flange adjacent said second end having an aperture defined therein for receiving a fastener for attaching said connector to said cooling fan bracket;

at least one pair of barbed guide flange members on said base, projecting in a first direction and disposed between said first end and said second end and adapted for penetration through said aperture and snap-fit engagement with said first wall portion;

an electrical connector portion projecting in a direction substantially opposite said first direction and adjoining said second end of said base, said electrical connector portion having a y-shaped portion between said connector flange and an elongated oval-faced connector adapted for forming an electrical connection;

a first dovetail portion on said base that projects substantially away from said first wall portion, and a second dovetail portion on said base that projects substantially away from said first wall portion;

said dovetail portions being configured to have a shape that is substantially complementary with the structure defining said recess in said second wall portion, for mating attachment thereto.

14. The connector of claim 13, wherein each of said pairs of L-shaped flanges are offset in opposite directions relative to each other.

15. The connector of claim 13, wherein said electrical connector portion includes a plurality of openings defined in a wall opposite said face for permitting access to said open center.

16. The connector of claim 13, wherein said dovetail portions and said electrical connector portion project from said base in substantially a same direction.

17. The connector of claim 13, wherein said second wall portion includes a pair of substantially parallel radially spaced walls.

* * * * *